United States Patent [19]

Stix

[11] 4,048,732

[45] Sept. 20, 1977

[54] SHOE AND METHOD OF MAKING THE SAME

[75] Inventor: Nathan Stix, Cincinnati, Ohio

[73] Assignee: The United States Shoe Corporation, Cincinnati, Ohio

[21] Appl. No.: 665,832

[22] Filed: Mar. 11, 1976

[51] Int. Cl.[2] ..... A43B 21/00; A43D 9/00

[52] U.S. Cl. ..... 36/34 B; 12/142 R

[58] Field of Search ..... 36/19.5, 24.5, 34 R, 36/34 A, 34 B, 102, 83

[56] References Cited

U.S. PATENT DOCUMENTS

| | | | |
|---|---|---|---|
| 1,927,990 | 9/1933 | Parlante | 36/34 B |
| 2,440,362 | 4/1948 | Braun | 36/34 B |
| 2,767,488 | 10/1956 | Meltzer | 36/34 B |

*Primary Examiner*—Patrick D. Lawson

*Attorney, Agent, or Firm*—Jones, Tullar & Cooper

[57] ABSTRACT

An improved shoe is disclosed having a relatively flexible shank portion utilizing no shank reinforcement. The shoe comprises a substantially flexible insole attached to an upper. A wedge heel is attached to the insole at the heel seat thereof, and a wedge tunnel cover is attached to the front face of the heel and the bottom of the insole forward of the heel. The rear edge of an outsole covers the front edge of the wedge tunnel cover and stitching may be used to lock the insole, the outsole, the wedge heel and the wedge tunnel cover together so that they adequately support the weight of the wearer. The improved shoe is constructed by a novel method so that the forepart of the shoe is made by slip lasting while the remainder of the shoe is made using a cement construction.

8 Claims, 4 Drawing Figures

SHOE AND METHOD OF MAKING THE SAME

FIELD OF THE INVENTION

The present invention relates, in general, to high-heeled shoes, and more particularly, to a shoe construction having a relatively flexible shank portion utilizing no shank reinforcement and a method for making the same.

DESCRIPTION OF THE PRIOR ART

There are some styles of shoes, particularly women's shoes, which utilize a very steep shank portion and an extremely high heel. In order for such shoes to properly carry the weight of the wearer without collapsing, the shank portion of the shoe is made relatively rigid either by a suitable choice of the shank material and its thickness or by providing a shank reinforcement, known as a shank piece. The shank piece is usually placed between the insole and the outsole and may be made of metal, wood, leather, fibreboard or plastic. However, such a rigid shank construction yields a relatively rigid shoe which is uncomfortable to wear. Such a rigid shoe is also more expensive to make due to the need for special shank materials or shank pieces and the extra manufacturing steps needed to insert the shank pieces in the shoe.

SUMMARY OF THE INVENTION

Accordingly, it is an object of the present invention to overcome the above noted disadvantages of prior art shoes, particularly women's shoes, by providing a shoe having a relatively flexible shank construction utilizing no shank reinforcement and a novel method for making such a shoe.

It is a further object of the present invention to provide a shoe having a relatively flexible shank construction which is comfortable to wear and long lasting, but which also adequately supports the wearer's weight without collapsing.

It is an additional object of the present invention to provide a shoe having a relatively flexible shank construction which is cheaper to make than the shoes of the prior art by dispensing with special shank materials and shank pieces.

It is another object of the present invention to provide a method of making a shoe having a relatively flexible construction in which the forepart portion of the shoe is constructed by a conventional slip lasting method and the remainder of the shoe is made with a conventional cement construction.

Briefly, the present invention accomplishes the foregoing and other objects by providing a shoe, preferably a woman's shoe, in which a substantially flexible insole, of the type customarily used in other women's shoes, may extend the length of the shoe and curve upward to form the arch without using any shank pieces to or special shank materials having a high degree of rigidity to reinforce the insole. In accordance with a preferred form of the invention, a wedge heel having a forward tapering portion which extends down the insole to the waist of the shoe is attached to the rear of the insole and helps support the weight of the person wearing the shoe. A wedge tunnel cover is cemented to the forward face of the heel and extends forwardly therefrom to be also cemented to the bottom surface of the insole for a short distance in front of the heel. An outsole is attached to the bottom of the insole and extends rearwardly to cover the front edge of the wedge tunnel cover.

A first line of very heavy stitching extends through the outsole, the front portion of the wedge tunnel cover and the insole and a second line of very heavy stitching extends through an intermediate portion of the wedge tunnel cover, the front portion of the heel and the insole. These two lines of stitching serve to lock together the insole, outsole, wedge tunnel cover and heel combination, so that these elements together provide the necessary rigidity for the shoe. In addition, this stitching serves to increase the durability and resistance to wear of the shoe according to the present invention over the durability exhibited if the insole, the outsole, the wedge heel and the wedge tunnel cover were only cemented together.

Besides providing a novel construction of a shoe having a relatively flexible shank construction utilizing no shank reinforcements, the present invention also provides a novel method for making such a shoe. The forepart portion of the shoe according to the present invention is made by slip lasting for greater flexibility and comfort while the remainder of the shoe is made according to the cement method of shoe construction for insuring that the heel will be firmly attached to the insole.

BRIEF DESCRIPTION OF THE DRAWINGS

The novel features of the invention are set forth with particularity in the appended claims, but the invention will be understood more fully and clearly from the following detailed description of a preferred embodiment of the invention as set forth in the accompanying drawings, in which:

DESCRIPTION OF THE PREFERRED EMBODIMENT

Figure 1:
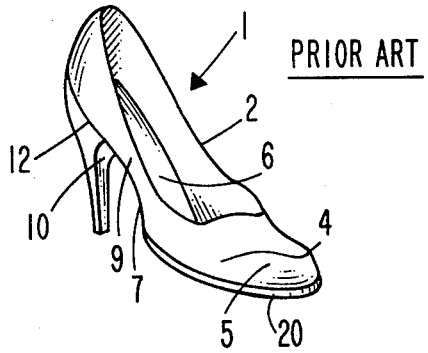
FIG. 1 is a perspective view of a shoe according to the prior art.

Referring now to FIG. 1, a conventional high- heeled shoe 1, illustrated here as a woman's shoe, comprises in general an upper 2, the lower portion 4 of the upper being known as the vamp. An insole 6, made of a suitably rigid material or reinforced with a steel shank piece, forms the bottom of the shoe 1 and includes a shank portion 7 which is that portion of the shoe along the arch 9 which comes under and supports the arch of the foot. A heel 10 is attached to the bottom of the shoe at the heel seat 12, and an outsole 20 may be attached to the bottom of the shoe 1 at the forepart 5 thereof, the forepart being the front portion of the shoe which is in advance of the shank 7.

Figure 2:
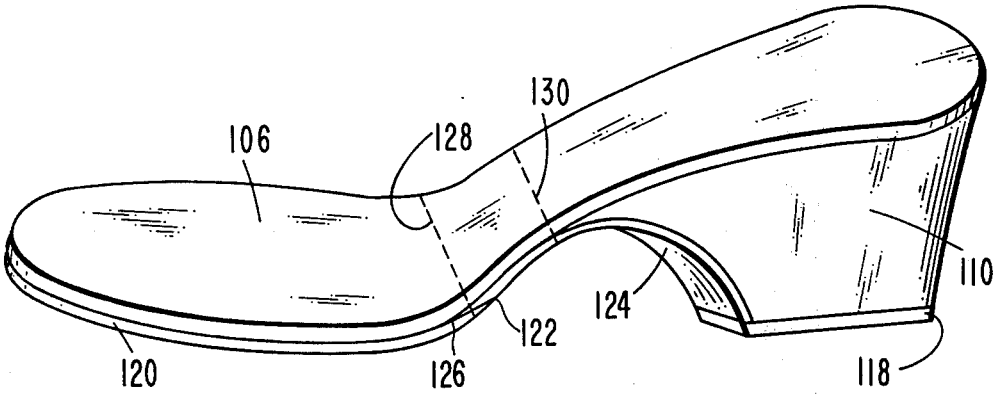
FIG. 2 is a perspective view of the shoe of the present invention showing the insole, outsole, wedge heel, and wedge tunnel cover.
Figure 3:
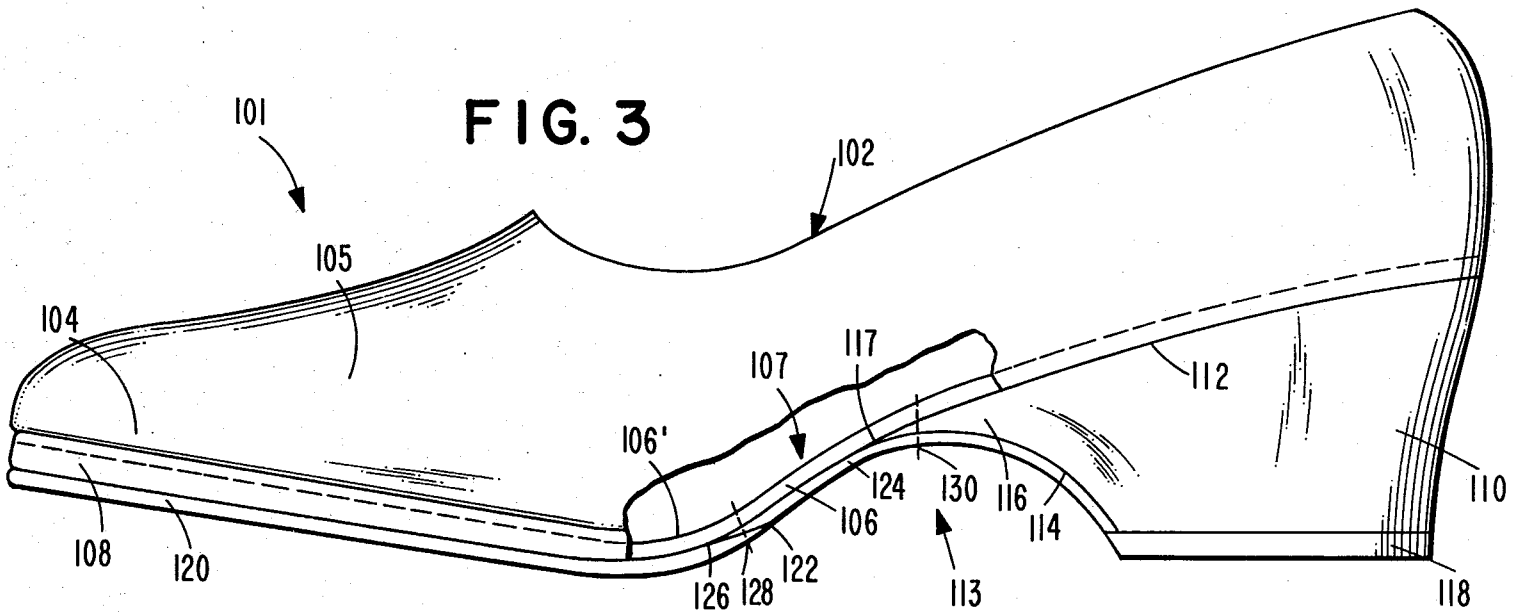
FIG. 3 is a side view of the shoe according to the present invention with a portion thereof broken away.
Figure 4:
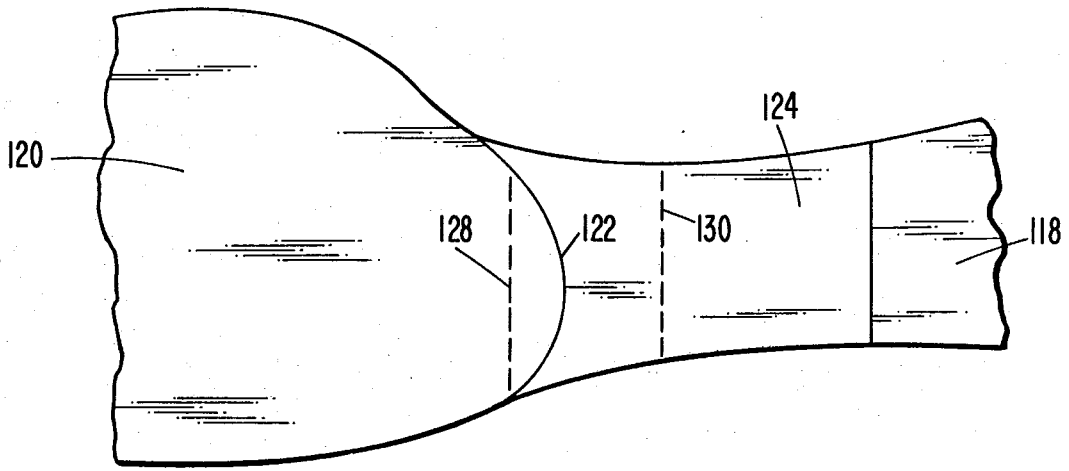
FIG. 4 is a partial bottom view of the shoe according to the present invention.

Referring now to FIGS. 2, 3 and 4, a shoe 101 according to the present invention, illustrated herein as a woman's shoe but not limited thereto, comprises an upper 102 having a vamp portion 104. A conventional insole 106, of the type used in many modern woman's shoes, runs the entire length of the shoe when installed and has a first flat portion underlying the forepart 105 of the shoe and an upwardly curved arch portion for the remainder of the shoe 101. The insole 106, although it extends over the shank portion 107 of the shoe, is not reinforced in any way by a shank piece and thus is very flexible and may comprise a cardboard base having a covering layer of a synthetic foam rubber or similar material; other materials could also be used in the insole 106 as long as its flexibility is maintained. The manner of attaching the insole 106 to the upper 102 and the method of manufacture of shoe 101 in general will be described in detail later.

In the illustrated embodiment of the invention, the shoe incorporates a forepart wrap 108 which is attached to the lower edge of the vamp 104 and is used to cover the forepart portion of the insole 106, the wrap 108 beginning at the front of shoe 101 and terminating at a position adjacent a point 106' where the insole 106 begins its upward curve to form the arch of the shoe. A wedge heel 110 is attached to the rear portion of insole 106 at the heel seat 112 thereof. The wedge heel forms a tunnel 113 between a front face 114 of the heal 110 and the forepart of the shoe, the wedge heel 110 having a forward tapering portion 116 which extends beneath the insole 106 a substantial distance to approximately the waist 117 of the shoe 101 to provide support therefor. The waist 117 of shoe 101 is that portion of the shoe along the insole 106 having the narrowest width. Attached to the bottom of heel 110 is a conventional heel lift 118.

An outsole 120 is attached along most of its length to the bottom surface of the insole 106 and extends rearwardly in the conventional manner to terminate at a bevelled rear edge 122 a short distance before the waist 117 of the shoe. A wedge tunnel cover 124, made of the same fabric as the upper 102, is secured to and covers the front face 114 of the heel and extends forwardly therefrom following the line of the insole 106. The front edge 126 of the wedge tunnel over 124 is bevelled and is placed or interfitted between the insole 106 and the rear edge 122 of the outsole 120. The heel 110 may be covered with the same fabric as that used in the upper 102, the forepart wrap 108 and the wedge tunnel cover 124 to give a uniform appearance to the shoe, if desired.

To strengthen the shoe, a first line 128 of very heavy stitching is placed across the shoe, the stitches passing through the rear portion of the outsole 120, through the front portion of the wedge tunnel cover 124 and through the insole 106 to hold these three elements firmly together. Similarly, a second line 130 of very heavy stitching is placed across the shoe 101, these stitches passing through an intermediate portion of the wedge tunnel cover 124, through the front portion of the heel 110 and through the insole 106. Both lines of stitching 128 and 30 are in addition to cement which may be used to hold together the insole 106, the outsole 120, the wedge heel 110 and wedge tunnel over 124.

The construction of the shoe just described gives an improved product over the conventional shoe which requires a steel shank reinforcement for the insole to provide the necessary rigidity. In the shoe according to the instant invention, the wedge heel 110, the wedge tunnel cover 124, the insole 106 and the outsole 120 are so constructed as to provide the necessary rigidity for supporting the arch of the foot, yet permit great flexibility, and hence comfort in the shoe. In addition, the present shoe enables a cheaper construction since the shank reinforcement element of the conventional shoe and the steps of manufacture necessary to insert such a shank are no longer necessary.

An important feature of the invention is the two lines of stitches 128 and 130 which serve to lock together the heel, the wedge tunnel cover, the insole and the outsole. While these elements of shoe 101 could be assembled only with cement, without the use of the lines of stitching 128 and 130, it has been found that such stitching serves to lock these elements together more firmly providing greater durability and resistance to wear than if these elements were only cemented together. The shoe of the instant invention then exhibits a longer life and better wear characteristics.

The shoe of the present invention is constructed in accordance with a novel method of manufacture wherein the forepart 105 of shoe 101 is constructed with a conventional slip last type of construction for comfort and flexibility while the remainder of the shoe, namely the shank 107 and heel seat 112 portions, is constructed with a traditional cement construction for a firm attachment of the wedge heel 110. More particularly, the shoe 101 is constructed according to the following method.

The upper 102 is first cut out of any desired material according to the pattern for the upper to form an upper blank and is then finished in a conventional manner by stitching the upper blank together along one side to form the single piece upper 102. Any necessary linings are inserted in the upper 102 and a counter pocket is placed in the rear thereof. Then the sock lining, which has a shape corresponding to only the front half of the finished shoe, that is, to the forepart portion 105 thereof, is stitched to the lower edge of the vamp 104 to form an enclosed forepart 105. The forepart wrap 108 is then stitched along its upper edge to the lower edge of the vamp 104 and a stiff counter piece is inserted in the counter pocket in a conventional manner. The foregoing sequence of steps may be referred to as assembling the upper.

Next, the forepart 105 of the shoe upper 102 is slip lasted in the following manner. The insole 106 is tacked to the bottom of a conventional shoe forming last at the shank portion of the insole only, with the front portion of the insole 106 being loose relative to the last. The assembled upper 102 is then slipped over the last so that the sock lining comes between the loose portion of the insole 106 and the last, and then the sock lining is cemented to the top surface of the forepart portion of the insole 106.

Next, the remainder of the shoe upper 102, namely the shank 107 and heel seat portions 112 thereof, is secured as follows. The remaining material of the upper 102 is gathered tightly around the last in a pulling over operation and is cemented and staple lasted to the insole 106 in the shank 107 and heel seat 112 portions thereof. The forepart wrap 108 may then be turned down over the insole 106 and cemented to the bottom surface of the forepart portion of the insole. When the forepart wrap 108 is turned down, the wrap completely covers both lines of stitching which connect the forepart wrap 108 and the sock lining respectively to the vamp 104 of the upper 102.

Finally, the shoe is finished in the following manner. The heel 110 is suitably attached, as by nailing and cementing, to the bottom of the insole 106 at the heel seat portion, and the wedge tunnel cover 124 is then cemented to both the front face 114 of the heel 110 and that portion of the insole 106 forward of the heel 110 over which the wedge tunnel cover 124 extends. The outsole 120 is then attached by cement to the bottom of the forward or forepart portion of the insole 106 and extends rearwardly to cover the front edge 126 of the tunnel wedge cover 124. The two lines of stitching 128 and 130 which interlock the heel 110, the tunnel wedge cover 124, the insole 106 and the outsole 120 are then placed across the shoe 101 at the appropriate locations. Any necessary inner liners may then be inserted into the shoe and the shoe finished off.

As is readily appreciated, the foregoing steps of constructing the shoe 101 illustrate that the forepart 105 of the shoe 101 is made by slip lasting while the remainder of the shoe 101 is constructed according to the traditional cement type of construction. The sequence of steps as illustrated is only a preferred form and many obvious variations thereof are possible. For example, the forepart wrap 108 could be turned down over the insole 106 and cemented to the forepart portion of the insole 106 before the upper 102 is staple lasted at the shank 107 and heel seat 112 portions. The forepart wrap 108 could also be stitched to the vamp 104 before the sock lining, rather than vice versa. Similarly, the insole 106 could be tacked to the bottom of the last at only the heel seat portion, or at both the heel seat and shank portions, rather than only at the shank portion.

In addition, the upper 102 can be of any style or shape and may even be omitted if a sandal type shoe embodying the flexible shank of the present invention were desired. Similarly, the forepart wrap 108 could be deleted if desirable or appropriate from an aesthetic stand point.

Although the present invention has been illustrated in terms of a preferred embodiment, it will be obvious to one of ordinary skill in the art that numerous modifications may be made without departing from the true spirit and scope of the invention and therefore that the scope of the invention is to be limited only by the appended claims.

What is claimed is:

1. An improved shoe construction having a forepart of slip last construction and having a waist portion and a heel portion of cement construction, said waist portion being without reinforcement to provide substantial flexibility between the forepart and heel portions of the shoe, the improvement comprising:

a shoe upper;

a substantially flexible insole extending the length of the shoe and secured to said upper;

a wedge heel attached to the rear portion of said insole, said wedge heel having a tapering forward portion extending along at least a part of the central portion of said insole to provide support for the waist portion of said shoe;

an outsole underlying the forepart of the shoe and attached to the forward portion of said insole;

a wedge tunnel cover attached to the front face of said wedge heel and extending forwardly therefrom to cover the waist portion of said insole between said heel and said outsole, said outsole covering the front edge of said wedge tunnel cover; and means securing said outsole to said tunnel cover and to said insole and for securing said tunnel cover to said forward portion of said wedge heel and said insole to provide a flexible shoe which provides adequate foot support without utilizing a stiff shank or shank reinforcement.

2. A shoe according to claim 1 wherein the forward portion of said wedge heel terminates at a position spaced from the rear edge of said outsole and the portion of said wedge tunnel cover forward of said position is attached to the bottom of the insole.

3. A shoe according to claim 1 wherein said securing means includes stitching to interlock said insole, said outsole, said wedge tunnel cover, and said wedge heel.

4. A shoe according to claim 3 wherein said stitching comprises a line of heavy stitches placed through the rear portion of said outsole, the front portion of said wedge tunnel cover and said insole.

5. A shoe according to claim 4 wherein said stitching further comprises a line of heavy stitches placed through an intermediate portion of said wedge tunnel cover, the front portion of said wedge heel and said insole.

6. A shoe according to claim 3 wherein said stitching comprises a line of heavy stitches placed through an intermediate portion of said wedge tunnel cover, the front portion of said wedge heel and said insole.

7. An improved shoe construction having a forepart of slip last construction and having waist and heel portions of cement construction, comprising:

an upper;

a substantially flexible insole attached to said upper;

a wedge heel attached to the rear portion of said insole, said wedge heel having a tapering front portion extending along at least a portion of a central part of said insole;

an outsole attached to the forward portion of said insole and spaced from said front portion of said wedge heel to define a waist portion therebetween;

a wedge tunnel cover attached to the front face of said wedge heel and extending forwardly therefrom to cover the waist portion of said insole, said outsole covering the front edge of said wedge tunnel cover; and stitching means interlocking said insole, outersole wedge tunnel cover and wedge heel, said stitch means including a line of heavy stitches placed through the rear portion of said outsole, the front portion of said wedge tunnel cover, and said insole, to secure said shoe for adequate support, without utilizing a stiff shank or shank reinforcement, whereby said waist portion of said insole remains flexible.

8. A shoe according to claim 7, wherein said stitch means further includes a second line of heavy stitches placed through an intermediate portion of said wedge tunnel cover, the front portion of said wedge heel, and said insole.

* * * * *